US005893513A

United States Patent [19]

Stone et al.

[11] Patent Number: 5,893,513

[45] Date of Patent: Apr. 13, 1999

[54] TWO-PIECE PAPERBOARD CONTAINER WITH POUR SPOUT

[75] Inventors: James L. Stone, Grand Rapids; Thomas J. Brink, Kentwood, both of Mich.

[73] Assignee: Tenneco Packaging Inc., Lake Forest, Ill.

[21] Appl. No.: 08/880,948

[22] Filed: Jun. 23, 1997

[51] Int. Cl.[6] ..... B65D 5/56; B65D 5/74

[52] U.S. Cl. ..... 229/215; 229/122.32; 229/122.33; 229/164.2

[58] Field of Search ..... 229/122.32, 122.33, 229/164.2, 215, 221, 225

[56] References Cited

U.S. PATENT DOCUMENTS

| | | | |
|---|---|---|---|
| 742,271 | 10/1903 | Allen | 222/565 |
| 939,825 | 11/1909 | Frank | 229/242 |
| 1,367,379 | 2/1921 | Gruenberg | 229/240 |
| 2,166,222 | 7/1939 | Ranko et al. | 222/565 |
| 2,543,084 | 2/1951 | Williamson et al. | 229/242 |
| 2,885,933 | 5/1959 | Phillips . | |
| 2,903,175 | 9/1959 | Pelmer . | |
| 3,133,689 | 5/1964 | Rossi . | |
| 3,184,137 | 5/1965 | Mohler . | |
| 3,185,377 | 5/1965 | Moore . | |
| 3,187,977 | 6/1965 | Graybill . | |
| 3,187,978 | 6/1965 | Graybill . | |
| 3,289,913 | 12/1966 | Svenson . | |
| 3,344,972 | 10/1967 | Robinson et al. . | |
| 3,362,612 | 1/1968 | Mohler . | |
| 3,568,910 | 3/1971 | McConnell . | |
| 4,317,518 | 3/1982 | Mode . | |
| 4,809,853 | 3/1989 | Weber . | |
| 4,852,764 | 8/1989 | Stone | 220/315 |
| 4,858,793 | 8/1989 | Stone | 222/541 |
| 4,909,395 | 3/1990 | Weissman . | |
| 4,944,406 | 7/1990 | Zehnal . | |
| 4,967,910 | 11/1990 | Schuster . | |
| 5,014,888 | 5/1991 | Bryan | 222/541 |
| 5,035,330 | 7/1991 | Kuchenbecker . | |
| 5,169,059 | 12/1992 | Desmond et al. | 229/215 |
| 5,205,480 | 4/1993 | Roccaforte | 229/229 |
| 5,222,660 | 6/1993 | Koss | 229/164.2 |
| 5,259,552 | 11/1993 | Kuchenbecker | 229/207 |
| 5,333,781 | 8/1994 | Roccaforte | 229/229 |
| 5,429,297 | 7/1995 | Walsh | 229/215 |
| 5,439,133 | 8/1995 | Stone . | |
| 5,452,850 | 9/1995 | Allsop | 229/219 |
| 5,518,174 | 5/1996 | Botterman | 229/164.2 |
| 5,531,376 | 7/1996 | Brink et al. | 229/215 |
| 5,582,344 | 12/1996 | Lawson et al. | 229/217 |
| 5,680,986 | 10/1997 | Botterman | 229/215 |

FOREIGN PATENT DOCUMENTS

| | | | |
|---|---|---|---|
| 92953 | 5/1962 | Denmark . | |
| 059251 | 5/1954 | France | 229/240 |
| 3832-544-C | 3/1990 | Germany . | |
| 606816 | 10/1960 | Switzerland . | |
| 1275802 | 5/1972 | United Kingdom . | |

*Primary Examiner*—Gary E. Elkins
*Attorney, Agent, or Firm*—Arnold, White & Durkee

[57] ABSTRACT

A two-piece paperboard container composed of an outer carton and liner includes a paperboard pour spout formed from portions of the outer carton and liner. The pour spout includes a spout body and a pair of spout wings hingedly connected to opposing edges of the spout body. The outer carton encompasses the liner and includes a spout body reinforcing panel overlying the spout body. The spout body reinforcing panel is adhered to the spout body and moves in tandem with the spout body in response to the pour spout being opened and closed. The outer carton further includes a plurality of top and bottom flaps adapted to form the respective top and bottom of the container. A pair of backboard panels extending from one of the top flaps are folded to form a backboard of the pour spout.

8 Claims, 5 Drawing Sheets

TWO-PIECE PAPERBOARD CONTAINER WITH POUR SPOUT

FIELD OF THE INVENTION

The present invention relates generally to paperboard containers and, more particularly, to a two-piece paperboard container including a paperboard pourspout.

BACKGROUND OF THE INVENTION

Pour spouts are employed on containers to dispense various types of products, including, but not limited to, granular products (e.g., pet litter, laundry detergent, dishwashing detergent, etc.), rice, cereal, dry pet food, and gun pellets. Although metal and plastic pour spouts have been applied to containers for many years, the application of such metal and plastic spouts is costly because the spouts require special and expensive application equipment and cause decreased assembly line efficiencies.

In an effort to reduce the costs associated with the application of pour spouts to containers, pour spouts composed of paperboard have been introduced to the marketplace in recent years. One of the preferred features of such paperboard pour spouts is that they be relatively durable and adaptable to a wide variety of container types and sizes. Other preferred features of such paperboard pour spouts is that they include tactile or audible feedback indicative of positive reclosure and are able to prevent spillage or sifting of the contents of the container in the area of the pour spout. Although pour spouts having such features have been developed for smaller/lighter one-piece paperboard containers, they have heretofore not been developed for larger volume and/or heavier cartons requiring liners.

Accordingly, a need exists for a paperboard pour spout which overcomes the above-noted shortcomings associated with existing pour spouts.

SUMMARY OF THE INVENTION

In accordance with one aspect of the present invention, there is provided a two-piece paperboard container having a reclosable pour spout for dispensing granular products. The container is comprised of a liner and an outer carton. The liner includes a plurality of inner sidewalls, one of which has a plurality of pour spout panels formed thereon. The plurality of pour spout panels includes a spout body panel and a pair of spout wings. The spout body panel is pivotally connected to the inner sidewall and the spout wings are hingedly connected to opposing edges of the spout body panel. The spout body panel and said spout wings define in combination the pour spout of the container. The outer carton includes a plurality of outer sidewalls encompassing the liner, one of which has a spout body reinforcing panel formed thereon. The outer carton and liner are aligned so that the spout body reinforcing panel overlies the spout body panel. The spout body reinforcing panel is pivotally connected to the outer sidewall and is adhered to the spout body panel such that it moves in tandem with the spout body panel in response to the pour spout being opened and closed. The outer carton further includes a plurality of top and bottom flaps hingedly connected to the outer sidewalls and folded relative to each other to form the respective top and bottom of the container. The top flap connected to the sidewall with the spout body reinforcing panel is hingedly connected to a pair of consecutively joined backboard panels adapted to form a backboard of the pour spout.

BRIEF DESCRIPTION OF THE DRAWINGS

Other objects and advantages of the invention will become apparent upon reading the following detailed description and upon reference to the drawings in which.

Figure 1:
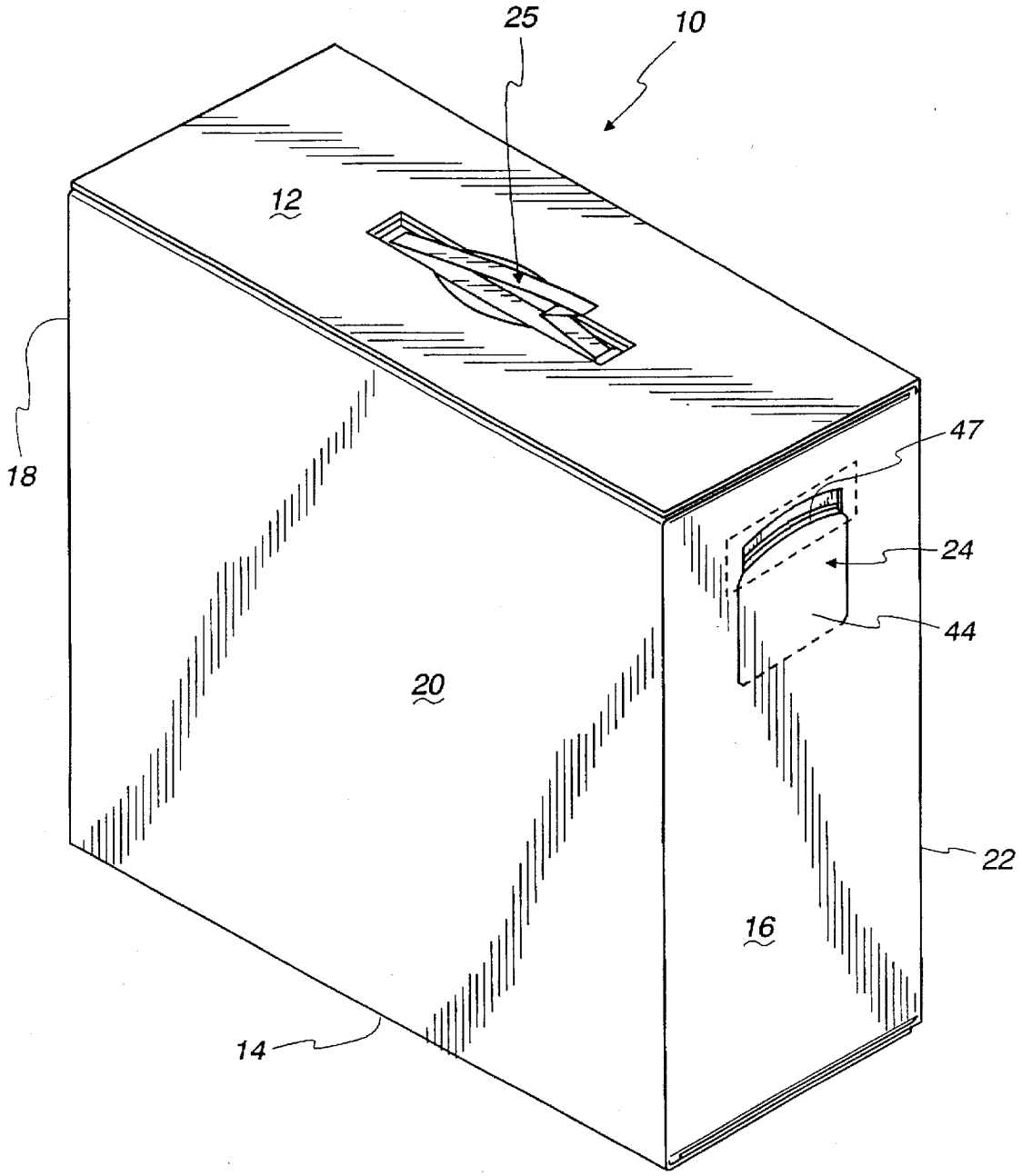
FIG. 1 is a perspective view of a paperboard container embodying the present invention showing a paperboard pour spout in a closed position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 9:
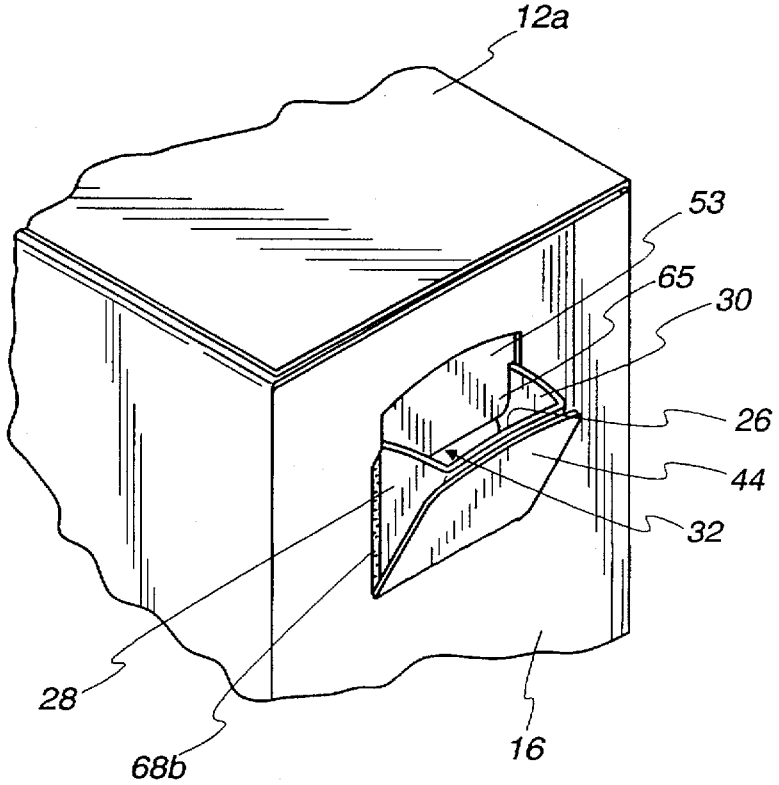
FIG. 9 is a partial perspective view of the paperboard container showing the paperboard pour spout in the open dispensing position as viewed from the exterior of the container.

Turning now to the drawings, FIG. 1 illustrates a paperboard container 10 embodying principles of the present invention. The container 10 includes opposing top and bottom walls 12 and 14, four side walls 16, 18, 20 and 22 bridging the top and bottom walls 12 and 14, and a paperboard pour spout 24. A paperboard liner (not shown) is disposed within the container 10 and forms a portion of pour spout 24, as will be described in relation to FIG. 3 hereinafter. The pour spout 24 is pivotally mounted to the side wall 16 for movement between a closed position (FIG. 1) and an open dispensing position (FIG. 9). As shown in FIG. 9, the pour spout 24 includes a spout body 26 and a pair of spout wings 28 and 30 hingedly connected to opposing edges of the spout body 26. The spout wings 28 and 30 extend into the interior of the container 10 via an opening 32 in the side wall 16. A handle 25 is provided on the top wall 12 of container 10 to facilitate lifting of container 10 and to provide a means of balancing container 10 as products are dispensed from pour spout 24.

Figure 2:
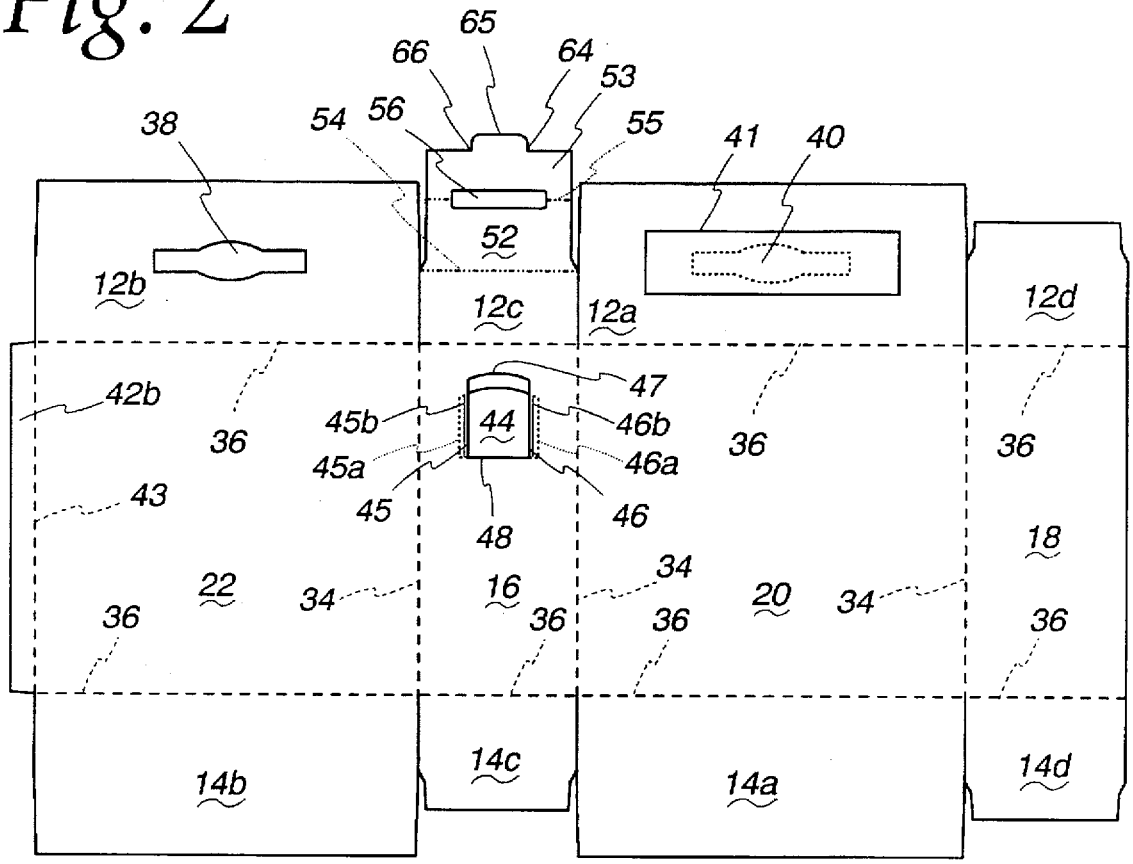
FIG. 2 is a plan view of an inside surface of a blank used to form a portion of the paperboard container in FIG. 1.

FIG. 2 is a plan view of an inside surface of a blank 35 used to form a portion of the paperboard container 10 in FIG. 1. The blank 35 is generally adapted to form the outer portion or "outer carton" of container 10. Accordingly, reference numeral 35 will hereinafter be designated by either term (e.g., outer carton 35 or blank 35) throughout the remainder of the disclosure. According to one embodiment, the outer carton 35 has a thickness in a range between about 0.014 inches and about 0.026 inches. As viewed in FIG. 2, the outer carton 35 includes four side wall panels 16, 18, 20 and 22 hingedly connected to each other along generally vertical fold lines 34. These side wall panels form the respective side walls of the paperboard container 10 in FIG. 1.

Figure 6:
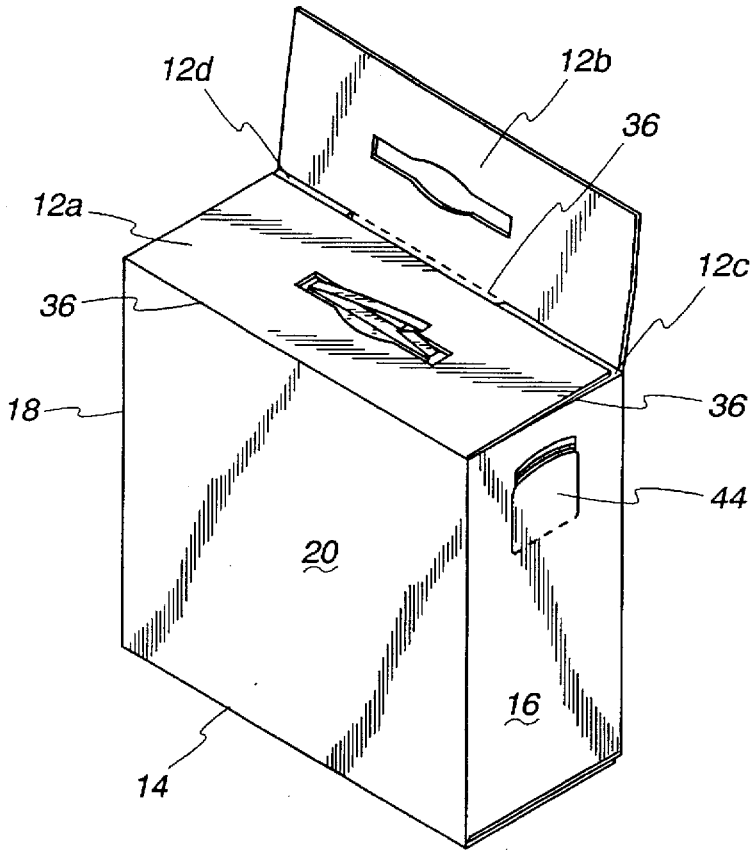
FIG. 6 is a perspective view showing another step in the sequence of forming the paperboard container in FIG. 1.

A plurality of top and bottom closure flaps are hingedly connected to opposing upper and lower edges of the side wall panels 16, 18, 20 and 22 along generally horizontal fold lines 36. In particular, top major flaps 12*a* and 12*b* are hingedly connected to the upper edges of the respective side walls 20 and 22, and top minor flaps 12*c* and 12*d* are hingedly connected to the upper edges of the respective side walls 16 and 18. The top closure flaps 12*a*, 12*b*, 12*c* and 12*d* fold as shown in FIG. 6 to form the top wall 12 of the paperboard container 10. Similarly, bottom major flaps 14*a* and 14*b* are hingedly connected to the lower edges of the respective side walls 20 and 22, and bottom minor flaps 14*c* and 14*d* are hingedly connected to the lower edges of the respective side walls 16 and 18. The bottom closure flaps 14*a*, 14*b*, 14*c* and 14*d* fold in conventional fashion to form the bottom wall 14 of the paperboard container 10.

Handle cutouts 38 and 40 are formed on respective top major flaps 12*b* and 12*a* to facilitate application of handle 25 to the container 10. Handle backstrip 41 is adhered to top major flap 12*a* so that it covers handle cutout 40. The handle 25 is adhered to the outward facing (not visible) surface of backstrip 41 and extends outwardly through handle cutout 40. When the container 10 is assembled, handle cutout 38 becomes aligned with handle cutout 40 so that the handle 25 extends outwardly through cutouts 38 and 40.

A spout body reinforcing panel 44 is created from the side wall 16 by means of a pair of vertical rev or reverse cuts 45 and 46, a cutout 47 elongated in the horizontal direction, and a horizontal fold line 48. Rev cuts 45 and 46 consist of two generally parallel score lines 45*a*, 45*b* and 46*a*, 46*b*, respectively, located in close proximity to each other. Rev cut 45 is formed from the first and second cut scores 45*a* and 45*b*, while rev cut 46 is formed from the first and second cut scores 46*a* and 46*b*. The first score lines 45*a* and 46*a* (illustrated by dashed lines in FIG. 2) are formed in the outer surface of the side wall 16. The second score lines 45*b* and 46*b* are formed in the inner surface of the side wall 16 approximately one-eighth to one-quarter inch inside the respective first score lines. Both the first and second score lines extend into the side wall 16 for a depth between about 30 and about 60 percent of the thickness of the side wall 16. The first score lines are angled inward at their upper and lower ends so that they intersect the second score line. The elongated cutout 47 bridges the upper ends of the cut scores 45*b* and 46*b*, while the horizontal fold line 48 bridges the lower ends of the cut scores 45*b* and 46*b*. The function of the rev cuts 45 and 46 is described below in connection with the description of the opening and closing of the pour spout 24.

A backboard having a pair of backboard panels 52 and 53 extends upwardly from the top minor flap 12*c*. The backboard span 52 is hingedly connected to the top minor flap 12*c* along a horizontal score line 54, and the backboard panel 53 is hingedly connected to the backboard span 52 along a horizontal fold line 55. A cutout 56 is formed along the fold line 55 to facilitate folding of the outer carton 35 into the paperboard container 10 of FIG. 1. A pair of shoulders 64, 66 are defined on opposing sides of a tab 65 extending upwardly from the top edge of backboard panel 53. As will be described below, the backboard prevents the pour spout 24 from collapsing into the container 10 upon closure of the pour spout 24.

Figure 3:
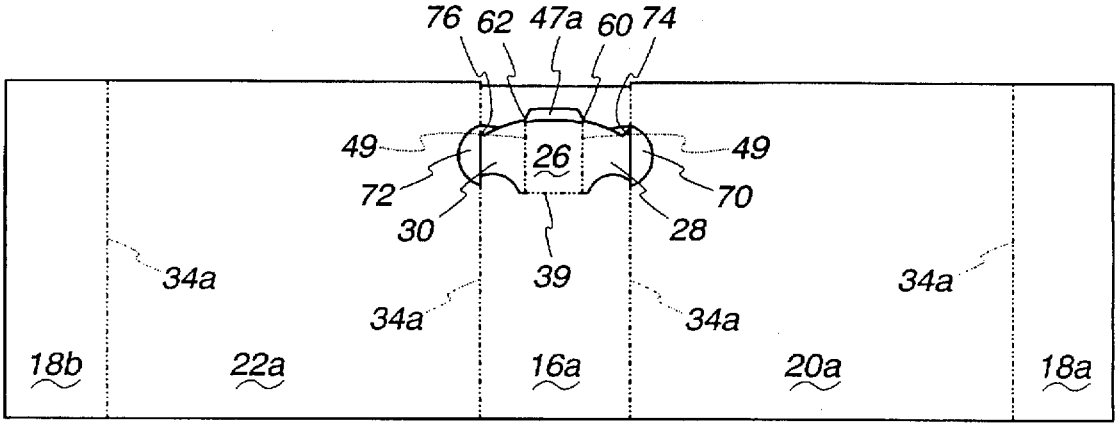
FIG. 3 is a plan view of an inside surface of a liner used to form another portion of the paperboard container in FIG. 1.

Now turning to FIG. 3, there is shown the inside surface of a paperboard liner 75 which forms a portion of the paperboard container 10 in FIG. 1. Generally, the liner 75 is adapted to be disposed within the container 10 so as to both strengthen the container 10 and form a portion of pour spout 24, as will be described in detail hereinafter. The liner 75 includes five side wall panels 16*a*, 18*a*, 18*b*, 20*a* and 22*a* hingedly connected to each other along generally vertical fold lines 34*a*. As will be described in greater detail in relation to FIG. 4, these side wall panels are adapted to be aligned and adhered to the corresponding sidewalls 16, 18, 20 and 22 of the container 10 as a first step in forming the container 10 in FIG. 1.

A plurality of pour spout panels are coupled to side wall panel 16*a* and used to form the pour spout 24 of the paperboard container 10. A spout body panel 26 is hingedly connected to side wall panel 16*a* along a horizontal fold line 39, and a pair of spout wing panels 28 and 30 are hingedly connected to opposing edges of the spout body panel 26 along vertical fold lines 49. As shown in FIG. 3, the spout wing panels 28 and 30 are initially generally coplanar with the spout body 26. An elongated cutout 47*a* is formed in side wall panel 16*a* above the spout body panel 26, and a pair of arch-shaped cutouts 70, 72 are formed in respective side panels 20*a*, 22*a* at outer edges of the spout wing panels 28 and 30. The spout wing panels 28 and 30 include respective bumps 60 and 62 positioned immediately adjacent to the respective fold lines 49 and stoppers 74 and 76 positioned adjacent respective cutouts 70, 72. The bumps 60, 62, stoppers 74, 76 and cutouts 47*a*, 74, 76 each serve a function related to opening of the pour spout, which will be described in detail in relation to FIGS. 7 through 9.

The sequence of forming the paperboard container 10 in FIG. 1 begins with the step of adhering liner 75 (FIG. 3) to the outer carton 35 (FIG. 2). Adhesive may be applied to either or both of liner 75 and outer carton 35, as is known in the art. In one embodiment, adhesive is applied to the inner surface of sidewalls 16, 18 of the outer carton 35 for adherence to respective sidewalls 16*a*, 18*a* of liner 75. Adhesive is also applied to the inner surface of reinforcing panel 44 for adherence to the outer surface of spout body 26. The liner 75 is aligned relative to the outer carton 35 so that the score lines 34*a* of liner 75 are positioned immediately above score lines 34 of outer carton 35, thereby causing side panel 16*a*, 20*a* and 22*a* of liner 75 to be aligned with respective side panels 16, 20 and 22 of outer carton 35. Side panel 18*a* of liner 75 is positioned atop corresponding side panel 18 of outer carton 35 but is sized to extend only partway across side panel 18. Conversely, side panel 18*b* of liner 75 is aligned above glue flap 42 of outer carton 35 but is sized to extend beyond the outer edge of glue flap 42.

The outer surface of spout body panel 26 is adhered to the inner surface of the reinforcing panel 44. The spout body panel 26 substantially overlaps the hidden reinforcing panel 44 such that the horizontal fold line 39 is aligned with the hidden fold line 48 and the vertical fold lines 49 are aligned with respective ones of the hidden score lines 45*b* and 46*b*. The respective cutouts 47 and 47*a* of liner 75 and outer carton 35 are aligned so that the upper edge of the spout body 26 is positioned below the cutouts 47, 47*a*. The score line 41 is aligned with the fold line 34.

Figure 4:
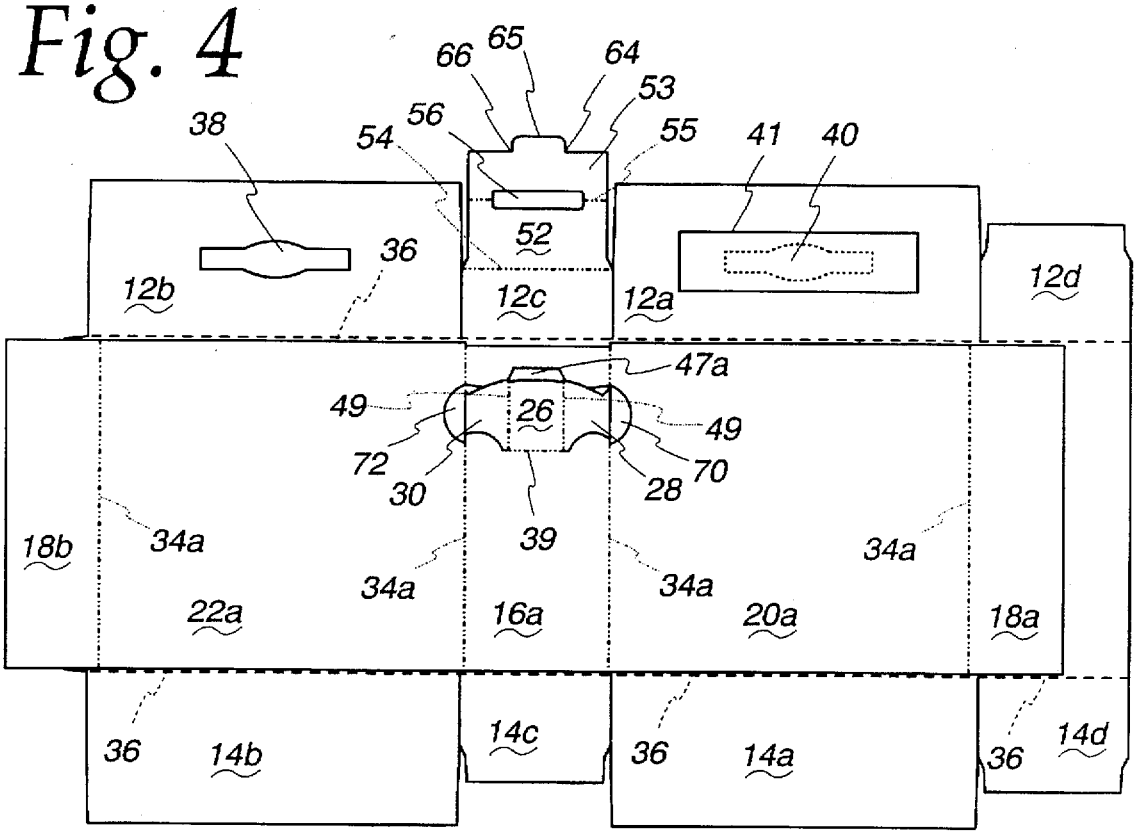
FIG. 4 is a plan view showing the liner of FIG. 3 adhered to the blank of FIG. 2 as a first step in the sequence of forming the paperboard container in FIG. 1.

In the two-piece structure shown in FIG. 4, any of several materials may be used for the liner 75 and outer carton 35, thereby providing a high degree of flexibility in the design of container 10 and permitting a wide variety of potential applications. For example, in one embodiment of the present invention, the liner 75 consists of E-flute cardboard with 0.30 WCCKB, thereby affording strong top-load compression protection. Such an embodiment has been found suitable, for example, in an application in which the container 10 is adapted to contain and dispense 20# cat litter.

Figure 5:
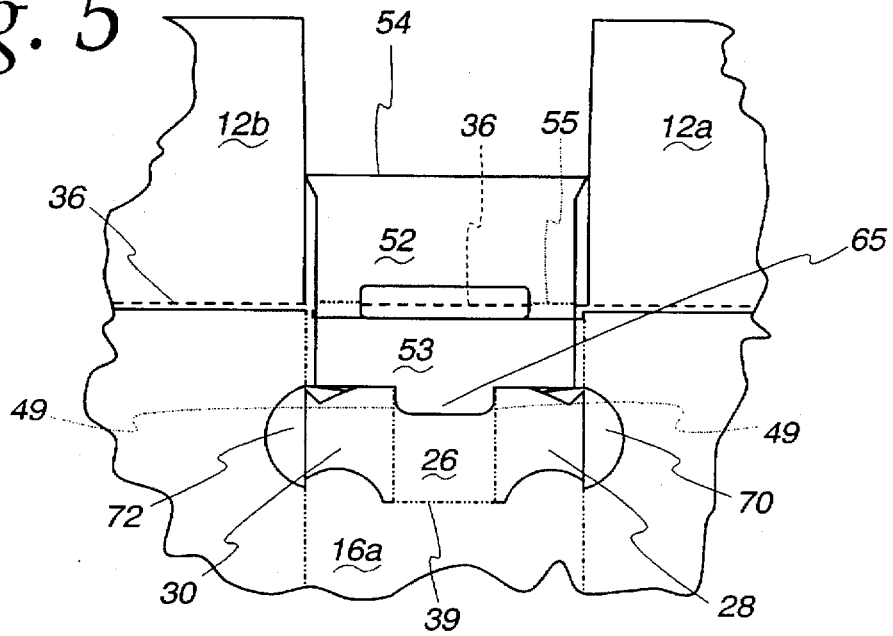
FIG. 5 is a plan view showing a second step in the sequence of forming the paperboard container in FIG. 1.

FIG. 5 illustrates a second step in the sequence of forming the paperboard container of FIG. 1. Adhesive is applied to the inner surface of the top minor flap 12*c* (not visible in FIG. 5) of outer carton 35 and to the upper portion (e.g. above spout body 26) of liner sidewall 16a. Then, the backboard span 52 is folded 180° along score line 54 so that it lies above and is adhered to top minor flap 12*c*. During this step, the fold line 55 between backboard panels 52, 53 becomes aligned with the fold line 36 connecting the minor flap 12*c* to the side wall 16. The cutout 56 exposes a portion of this fold line 36. Additionally, the backboard panel 53 becomes adhered to the upper portion of liner sidewall 16*a*, covering the cutouts 47, 47*a* and overlapping (but not adhering to) an upper portion of the spout body 26. In the area where the backboard panel 53 overlaps the spout body 26, the inner surface of the backboard panel 53 abuts the outer surface of the spout body 26.

After folding and gluing the pour spout panels in the manner heretofore described, the combination of outer carton 35 and liner 75 is folded and glued in conventional fashion to form the paperboard container 10 with enclosed liner 75. According to one embodiment, adhesive is applied to the outer surface of the glue flap 42 and to the inside surface (outer edge) of liner side panel 18*a*. Next, the outer carton 35 and liner 75 are folded about the vertical fold lines 34, 34*a* to adhere the outer surface of the glue flap 42 to the inner surface of the side wall panel 18 along its free vertical edge, and to adhere the outer surface of liner side panel 18*b* to the inner surface of liner side panel 18*a*. At this point, the container 10 formed from the combination of outer carton 35 and liner 75 is in tubular form with open top and bottom ends. Typically, the bottom of the container is enclosed and sealed by folding and gluing bottom flaps 14*a,b,c,d* in the manner known in the art, then the container is filled with product via the open end (e.g., the top end) of the container.

Referring to FIG. 6, the filled container is then sealed by appropriately folding and gluing the top major and minor flaps. First, in the illustrated embodiment, the top minor flaps 12*c* and 12*d* are folded inward about the associated fold lines 36 so that they are substantially perpendicular to the respective side walls 16 and 18. Next, the top major flaps 12*a* and 12*b* are folded inward about the associated fold lines 36 so that they are substantially perpendicular to the side wall 20. Referring back to FIG. 5, since the fold line 55 connecting the backboard panels 52 and 53 is aligned with the fold line 36 connecting the top minor flap 12*c* to the side wall 16, folding the top minor flap 12*c* causes the backboard span 52 to rotate with the top minor flap 12*c* about the fold line 55 to a position substantially perpendicular to the side wall 16. The cutout 56 facilitates the rotation of backboard span 52 about fold line 55 by preventing the paperboard from bunching or crimping along the aligned fold lines 55 and 36. Since the backboard span 52 substantially overlaps and is adhered to the top minor flap 12*c*, the backboard span 52 essentially serves as a part of the top minor flap 12*c*.

Once the top minor flaps 12*c* and 12*d* are folded inward, the outer surface of the top minor flap 12*d* abuts the inner surface of the top major flap 12*a*. Also, due to the overlap of the backboard span 52 and the top minor flap 12*c*, the outer surface of the backboard span 52 abuts the inner surface of the top major flap 12*a*. After applying adhesive to the outer surfaces of the inwardly-folded top flaps 12*a*, 12*c*, and 12*d*, the top major flap 12*b* is folded inward approximately 90 degrees about the associated fold line 36. The adhesive attaches the inner surface of the top major flap 12*b* to the outer surfaces of the flaps 12*a*, 12*c*, and 12*d*, thereby sealing the top wall 12 as depicted in FIG. 1.

Figure 7:
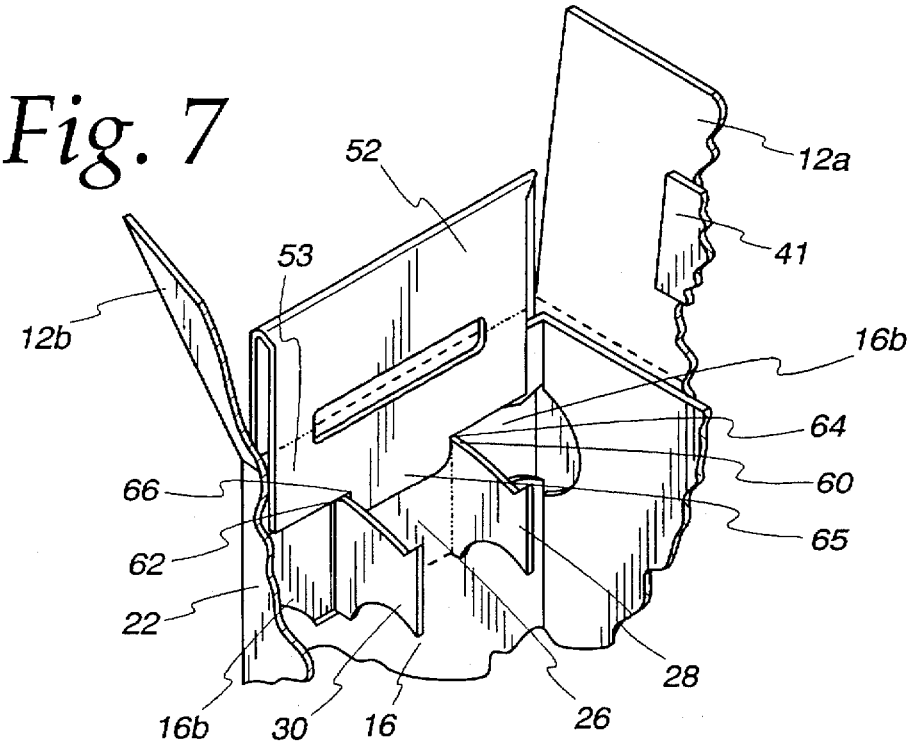
FIG. 7 is a partial perspective view of the paperboard container in FIG. 1 showing the paperboard pour spout in the closed position as viewed from the interior of the container.

The integral paperboard pour spout 24 will now be described in detail with reference to FIGS. 1 and 7–9. Referring first to FIGS. 1 and 7, there is shown the pour spout 24 in the closed position. Prior to initially opening the pour spout 24, the narrow strip of paperboard encompassed by the score lines of each of the rev cuts 45 and 46 (FIG. 2) is still intact. To prevent leakage of the container contents prior to initially opening the pour spout 24, a peelable label is preferably adhered to the side wall 16 to cover the cutout 47 in FIG. 1. The region of the side wall 16 occupied by the peelable label is indicated by the dotted lines in FIG. 1.

In the closed position of the pour spout 24, the spout wings 28 and 30 are fully disposed within the container 10. The bumps 60 and 62 on respective spout wings 28 and 30 are releasably engaged with the respective shoulders 64 and 66 (FIGS. 2 and 7) on the folded-over backboard panel 53. When the pour spout 24 is in the closed position, the bumps 60 and 62 engage the respective shoulders 64 and 66 to assist in maintaining the pour spout in the closed position.

Figure 8:
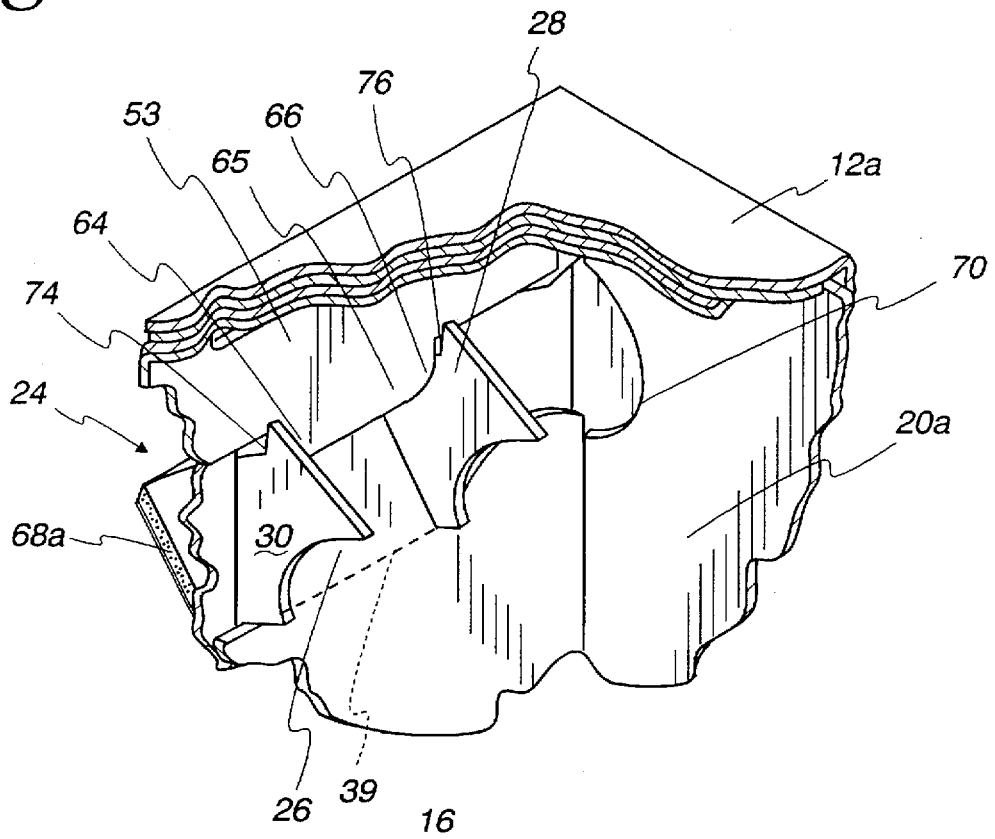
FIG. 8 is a partial perspective view of the paperboard container showing the paperboard pour spout in an open dispensing position as viewed from the interior of the container.

To initially open the pour spout 24, the user first removes the peelable label described above. Next, the user inserts his or her finger(s) into the cutout portion 47, 47*a* formed respectively in the outer carton 35 and liner 75, engages the upper edges of the spout body 26 and reinforcing panel 44, and pulls outwardly on the spout body 26 and reinforcing panel 44. In response to the application of a sufficient amount of opening force, the bumps 60 and 62 in FIG. 7 are forced past the respective shoulders 64 and 66. Also, the strips of paperboard encompassed by the respective rev cuts 45 and 46 (FIG. 2) are delaminated into inner and outer layers to permit the pour spout 24 to be pivoted about the fold lines 39 and 48 to the open dispensing position. More specifically, the strip of paperboard between the cut scores 45*a* and 45*b* (FIG. 2) is delaminated into inner and outer layers. Similarly, the strip of paperboard between the cut scores 46*a* and 46*b* (FIG. 2) is delaminated into inner and outer layers. The inner layers remain attached to the main stationary portion of the side wall 16, while the outer layers are torn away from this main stationary portion and are carried with the reinforcing panel 44. FIG. 8 depicts a torn-away outer layer 68*a* of paperboard created by the rev cut 46 (FIG. 2), and FIG. 9 depicts the inner layer 68*b* of paperboard created by that rev cut 46.

FIGS. 8 and 9 depict the pour spout 24 in the open dispensing position. As the pour spout 24 is rotated to this open dispensing position, the spout wings 28 and 30 slide along the shoulders 64, 66 formed on opposing sides of the tab 65 of the folded-down backboard panel 53, swinging inwardly from an initial position (substantially parallel with spout body 26 upon first opening) to an open position oriented generally perpendicular to the spout body 26. The cutouts 70, 72 adjacent to the respective spout wings 28, 30 facilitate the swinging inward of the spout wings 28, 30 by preventing them from locking up upon initial opening of pour spout 24.

After closing the container, the spout wings 28 and 30 generally do not return to their initial position (e.g., parallel to spout body 26) but rather tend toward a more perpendicular orientation relative to spout body 26 due to "score memory" along score lines 49 (FIG. 3). Nevertheless, in the open position, the spout wings 28 and 30 are generally perpendicular to the spout body 26 and extend outwardly from container 10, causing the opening 32 in FIG. 9 to become unobstructed. This unobstructed opening 32, in turn, permits the contents of the container 10 to be freely dispensed via the pour spout 24. The pour spout 24 is strictly confined to the illustrated open position by the respective stoppers 74 and 76 positioned on outer edges of the respective spout wings 28 and 30. More specifically, upon fully opening pour spout 24, the raised edges of stoppers 74 and 76 abut against the backboard panel 53 to prevent movement of the pour spout 24 beyond the illustrated open position.

After the user dispenses the desired amount of contents from the container 10, the pour spout 24 is reclosed to the closed position shown in FIG. 7 by pushing inwardly on the reinforcing panel 44. To prevent the pour spout 24 from collapsing into the container 10 upon reclosure, inward rotation of the pour spout 24 is limited by the backboard panel 53 and the inner layers formed by the rev cuts 45 and 46. Each of the foregoing elements assist in preventing rotation of the spout body 26 and reinforcing panel 44 beyond the closed position in FIG. 7. When the spout body 26 and reinforcing panel 44 reach the closed position, the spout body 26 contacts the backboard panel 53. Likewise, the inner surfaces of the outer layers formed by the rev cuts 45 and 46 contact the outer surfaces of the associated inner layers. In addition to preventing the pour spout 24 from collapsing into the container 10, the delaminated paperboard strips formed by the rev cuts 45 and 46 provide the pour spout 24 with sift-resistance in proximity to the spout wings 28 and 30. The delaminated strips hinder the contained product from spilling out of the container 10 via the sides of the pour spout 24.

Reclosing the pour spout 24 leads to snap re-engagement of the bumps 60 and 62 and the respective shoulders 64 and 66. This snap re-engagement provides tactile and audible feedback indicative of effective reclosure of the pour spout 24. It has been determined in this regard that the presence of such tactile and audible feedback indicative of effective locking is desirable because the presence thereof provides consumers with a high "comfort" factor with respect to reclosure. Particularly in applications where the container 10 is used to house a product having a restricted storage life once the pour spout 24 has been initially opened, such positive feedback has been determined to provide an apparent sense of reassurance to consumers as to retention of "freshness", "safety", or scent of the contained product.

As stated in connection with FIG. 4, the reinforcing panel 44 substantially overlaps and is adhered to the spout body 26. Therefore, as the pour spout 24 is pivoted between the closed position and the open dispensing position, the spout body 26 and reinforcing panel 44 move in tandem with each other. The overlapping layers of paperboard provided by the spout body 26 and reinforcing panel 44 enhance the durability of the pour spout 24, thereby allowing the pour spout 24 to be repeatedly opened and closed without sustaining damage.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A two-piece paperboard container having a reclosable pour spout for dispensing granular products, said container comprising:

a liner including a plurality of inner sidewalls, a first one of said inner sidewalls having a plurality of pour spout panels formed thereon, said plurality of pour spout panels including a spout body panel and a pair of spout wings, said spout body panel being pivotally connected to said first inner sidewall, said spout wings being hingedly connected to opposing edges of said spout body panel, said spout body panel and said spout wings defining in combination the pour spout of said container, said pour spout being adapted to move between a closed position and an open dispensing position; and an outer carton including a plurality of outer sidewalls each having upper and lower edges, said outer sidewalls encompassing said liner and being aligned relative to said liner such that a first one of said outer sidewalls overlays the first one of said inner sidewalls, said first outer sidewall having a spout body reinforcing panel formed thereon, said spout body reinforcing panel being pivotally connected to said first outer sidewall and aligned and adhered to said spout body panel so as to move in tandem with said spout body panel in response to movement of said pour spout between said closed position and said open position, a plurality of bottom flaps hingedly connected to the lower edges of said side walls and folded relative to each other to form a bottom of said container, and a plurality of top flaps hingedly connected to the upper edges of said side walls and folded relative to each other to form a top of said container, said plurality of top flaps including a first top minor flap connected to the upper edge of said first side wall and forming a portion of the top of said container, said first top minor flap being hingedly connected to a pair of consecutively joined backboard panels, a first one of said pair of backboard panels being folded over said first top minor flap such that an inner surface of said first backboard panel is adjacent to an inner surface of said first top minor flap, a second one of said backboard panels extending into said container to define a backboard of said pour spout, an upper portion of said backboard overlapping an upper portion of said first inner sidewall and a lower portion of said backboard partially overlapping an upper portion of said spout body panel.

2. The two-piece container of claim 1 wherein a plurality of bumps are formed on upper edges of said spout wings, said bumps being positioned immediately adjacent to opposing edges of said spout body panel and being adapted to releasably engage with a pair of shoulders formed on the lower portion of said backboard.

3. The two piece container of claim 1 wherein the inner sidewalls on opposing sides of said first inner sidewall have material cut away to define respective cutouts on either side of said spout wings.

4. The two-piece container of claim 1 wherein the spout body reinforcing panel is detachably engaged to said first outer sidewall by a pair of rev cuts formed on opposing sides of said spout body panel, said spout body reinforcing panel becoming delaminated and torn away from said first outer sidewall in response to first opening said container.

5. The two piece container of claim 1 wherein portions of said first outer sidewall and said first inner sidewall have material cut away to define respective cutouts aligned above said pour spout.

6. A unitary blank of paperboard material for forming an outer carton of a two-piece paperboard container having a reclosable pour spout, said blank comprising:

a plurality of sidewall panels each having upper and lower edges, a first one of said sidewall panels having a spout body reinforcing panel formed thereon, said spout body reinforcing panel being pivotally connected to said first sidewall panel, a plurality of bottom flaps hingedly connected to the lower edges of said sidewall panels, and a plurality of top flaps hingedly connected to the upper edges of said sidewall panels, said plurality of top flaps including a first top minor flap connected to the upper edge of said first sidewall panel, said first top minor flap being hingedly connected to a pair of consecutively joined backboard panels, said backboard panels being adapted to be folded relative to each other and to the first top minor flap to form a backboard disconnected from said pour spout.

7. A set of two unitary blanks of paperboard material for forming a two-piece paperboard container having a reclosable pour spout, said set comprising, in combination:

a liner blank including a plurality of inner sidewall panels, a first one of said inner sidewall panels having a plurality of pour spout panels formed thereon, said plurality of pour spout panels including a spout body panel and a pair of spout wings, said spout body panel being pivotally connected to said first inner sidewall, said spout wings being hingedly connected to opposing edges of said spout body panel, said spout body panel and said spout wings being adapted to form the pour spout of said container; and a outer carton blank including a plurality of outer sidewall panels each having upper and lower edges, a first one of said outer sidewall panels having a spout body reinforcing panel formed thereon, said spout body reinforcing panel being pivotally connected to said first outer sidewall panel, a plurality of bottom flaps hingedly connected to the lower edges of said sidewall panels, and a plurality of top flaps hingedly connected to the upper edges of said sidewall panels, said plurality of top flaps including a first top minor flap connected to the upper edge of said first sidewall panel, said first top minor flap being hingedly connected to a pair of consecutively joined backboard panels.

8. A reclosable pour spout structure for a two-piece paperboard container formed from a liner blank and an outer carton blank, the pour spout structure comprising:

a pour spout comprising a spout body panel and a pair of spout wings each defining a portion of said liner blank, the spout body panel being pivotally connected to a first inner sidewall of said liner blank, the spout wings being hingedly connected to opposing edges of said spout body panel; and a spout body reinforcing panel defining a portion of said outer carton blank, the spout body reinforcing panel being pivotally connected to a first outer sidewall of said outer carton blank and aligned and adhered to said spout body panel so as to move in tandem with said spout body panel between a closed position and an open dispensing position.

* * * * *